US011103109B2

(12) United States Patent
Schluter

(10) Patent No.: US 11,103,109 B2
(45) Date of Patent: Aug. 31, 2021

(54) RAIL PROFILE WITH ATTACHMENT MECHANISM AND RELATED METHODS

(71) Applicant: Schluter Systems L.P., Plattsburgh, NY (US)

(72) Inventor: Werner Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 16/682,741

(22) Filed: Nov. 13, 2019

(65) Prior Publication Data

US 2020/0170453 A1 Jun. 4, 2020

(30) Foreign Application Priority Data

Nov. 26, 2018 (DE) ..... 20 2018 106 711.7

(51) Int. Cl.
*F16B 37/00* (2006.01)
*A47K 1/09* (2006.01)

(52) U.S. Cl.
CPC ..... *A47K 1/09* (2013.01); *A47K 2201/02* (2013.01)

(58) Field of Classification Search
CPC ..... E04B 1/58; E04B 2001/5881
See application file for complete search history.

(56) References Cited

U.S. PATENT DOCUMENTS 2,928,512 A * 3/1960 Slater ..... F16B 37/045 403/22
4,040,228 A * 8/1977 Skubic ..... E04B 1/4107 52/710
8,251,329 B2 * 8/2012 Suciu ..... G09F 15/0018 248/316.2
2011/0147553 A1 * 6/2011 Ostermeier ..... F24S 25/634 248/223.41
2011/0253859 A1 * 10/2011 Ostermeier ..... F24S 25/634 248/223.41
2012/0273644 A1 11/2012 Lin
2015/0316086 A1 * 11/2015 Urban ..... F24S 25/65 403/374.3
2020/0340236 A1 * 10/2020 Schluter ..... E04F 19/062

FOREIGN PATENT DOCUMENTS

WO WO 90/09135 8/1990

* cited by examiner

*Primary Examiner* — Steven M Marsh
(74) *Attorney, Agent, or Firm* — Jason R. Jones

(57) ABSTRACT

A profile system comprises at least one elongated rail profile which extends in a longitudinal direction and has a constant cross-section, and at least one holding element which is designed to be detachably fastened to the rail profile. The rail profile, viewed in cross-section, has a substantially rectangular base section which is provided on its front side with a receiving groove extending in the longitudinal direction which describes a circular arc extending over at least 200° and having a first radius $R_1$ and is accessible via a groove opening of a predetermined groove width, and at least one first fastening leg which adjoins the rear side of the base section substantially flush and projects outwards from the base section.

17 Claims, 15 Drawing Sheets

A (1:1)

RAIL PROFILE WITH ATTACHMENT MECHANISM AND RELATED METHODS

PRIORITY CLAIM

Figure 1:
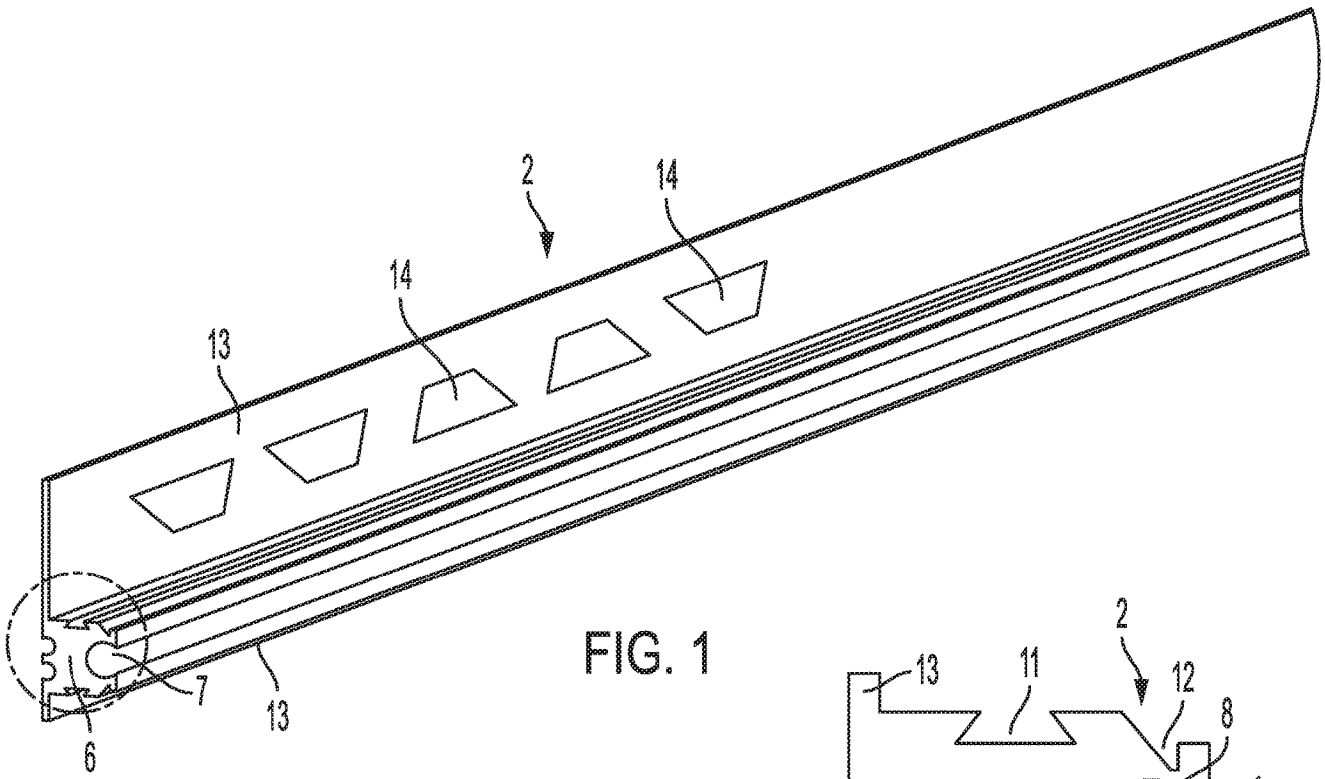

Priority is claimed of and to German Patent Application Serial No. 20 2018 106 711.7, filed Nov. 26, 2018, which is hereby incorporated herein by reference in its entirety.

DESCRIPTION

The present invention relates to a profile system comprising at least one elongated rail profile, which extends in a longitudinal direction and has a constant cross-section, and at least one holding element, which is designed to be detachably fastened to the rail profile.

Profile systems of the type mentioned at the beginning are known in the state of the art in a wide variety of designs. The rail profile is mounted on a wall, whereupon at least one holding element can be detachably fastened to the rail profile. A wide variety of objects can be mounted on the holding element (S), such as shelves, tool holders or the like, to name just a few examples.

The detachable fastening of the at least one holding element to the rail profile can be realized in various ways. For example, document WO 90/09135 discloses a form-fitting connection between a holding element receiving an object or defining such an object and a plate to be fastened to a wall, which can be mounted by clipping it onto the front or alternatively by sliding it onto the side. In both cases a secure connection is guaranteed. However, a disadvantage of frontal clipping is that it requires a lot of effort. Sufficient space must be available for the lateral sliding which is not always given.

Document US 2012/0273644 A1 describes a profile system with a rail profile to be mounted on a wall and a holding element supporting an object, in which the holding element is inserted into the rail profile and held in a form-fitting manner to it. The design described in this document allows a secure fastening, in particular when the object to be fastened to the wall has a high weight. However, in the case of lighter objects, the fastening may be inadvertently released if a force is applied to the object from below.

Based on this prior art one of the tasks of the present invention is to create a profile system of the type mentioned at the beginning, in which the holding element can be easily and detachably fastened to the profile rail without great effort.

To solve this task the present invention creates a profile system of the type mentioned at the beginning in which the rail profile, viewed in cross-section, has a substantially rectangular base section, which is provided on its front side with a receiving groove extending in the longitudinal direction which describes a circular arc extending over at least 200° and having a first radius $R_1$ and is accessible via a groove opening of a predetermined groove width, and at least one first fastening leg which adjoins the rear side of the base section substantially flush and projects outwards from the base section, and in which the holding element has a holding section and an elongatedly formed connecting section fastened to the holding section and extending in the longitudinal direction, the connecting section comprising at least one bar extending outwards from the holding section and a cylindrical joint head which is arranged at the free end of the bar and whose circumferential surface, viewed in cross-section, describes a circular arc with the radius $R_2$, which is equal or slightly smaller than the radius $R_1$, the maximum distance between the circular chord delimiting the circular arc and the circumferential surface being slightly smaller than the groove width so that the joint head can be inserted into the receiving groove via the groove opening in a specific swivel position of the holding element relative to a swivel axis extending in the longitudinal direction and can be locked within the receiving groove in the context of a swivel movement about the swivel axis. Accordingly, the joint head of the holding element can be inserted frontally through the groove opening into the receiving groove of the profile rail in the predetermined swivel position without having to overcome any resistance, as it is the case with clip connections. In consequence, no great effort is required for insertion. To fasten or to lock the joint head within the receiving groove, the joint head is swiveled together with the holding element about the swivel axis. When swiveled, the joint head can no longer be moved through the groove opening, whereby a secure hold of the holding element on the profile rail is ensured.

Preferably, undercut recesses are provided on the rear side and/or on the upper side and/or on the underside of the base section of the rail profile. An adhesive or mortar by means of which the rail profile is fastened to a wall, can claw itself into such recesses.

According to an embodiment of the present invention, a recess is provided in the corner region between the underside and the front side of the base section and/or in the corner region between the front side and the upper side of the base section and/or in the corner region between the upper side and the rear side of the base section, said recess defining a grout chamber. Preferably, the recess is provided with an undercut, which is positioned and designed in such a way that grout introduced into the recess can claw into it.

According to the invention, the fastening leg can be provided with a plurality of passage openings, which are preferably uniformly spaced apart from one another in the longitudinal direction. An adhesive or mortar can pass through such openings to fasten the rail profile to a wall, ensuring a secure hold.

The rail profile and the holding element are preferably made of metal, in particular of aluminum or stainless steel, which results in a very good strength and corrosion resistance.

Advantageously, the holding section of the holding element is plate-shaped. Many different objects can be attached to such a plate-shaped holding section so that the holding element can be used flexibly.

The bar of the connecting section preferably projects from the holding section at an angle in the range from 100° and 110°, in particular upwards from the holding section. Such an oblique connecting section facilitates the insertion of the joint head into the receiving groove.

According to an embodiment of the present invention, the joint head is provided with a receiving deepening extending in the longitudinal direction, into which a rubber lip serving for tolerance compensation is inserted. By means of such a rubber lip, deviations between the radii $R_1$ and $R_2$ can be compensated to ensure good fit of the joint head in the receiving groove.

Advantageously, a spacer is provided on the rear side of the holding section, the spacer in particular being provided with an elastic contact element.

Preferably, a decorative plate, in particular in the form of a glass plate, is fastened to the holding section.

A bath utensil, in particular in the form of a towel holder, a toilet paper roll holder, a toilet brush holder, a shower gel tray or the like, is preferably fixed to the decorative plate.

According to an embodiment of the present invention, the profile system comprises a rubber profile adapted to be clipped into the receiving groove. By means of such a rubber profile those areas of the receiving groove in which no holding element is arranged can be filled. This prevents the receiving grooves from becoming dirty. On the other hand, it prevents a holding element arranged in the receiving groove from moving backwards and forwards.

Preferably, the rubber profile comprises a fastening section and a cover section, the fastening section being adapted to be detachably inserted into the receiving groove, and the cover section being adapted to cover the front side of the base section in the inserted state. Correspondingly, a visually appealing appearance is achieved.

The fastening section preferably comprises upwardly and downwardly projecting ribs which in particular point in the direction of the cover section.

Thanks to such ribs a firm hold is achieved.

In principle, the cover section can have any shape. However, preferably it has a convexly curved outer surface.

According to an embodiment of the present invention, at least one end cap is provided which is adapted to be plugged at the ends onto the rail profile, the end cap having a plate section, which covers the rail profile at the ends and whose outer contour preferably corresponds to the outer contour of the end face of the rail profile, and at least one plug section projecting from the plate section.

Furthermore, the profile system may comprise a cover element which is adapted to be placed as a cover at least on the holding section of the holding element, the cover element preferably having a substantially C-shaped form. Accordingly, the holding section is not visible from above.

Figure 2:
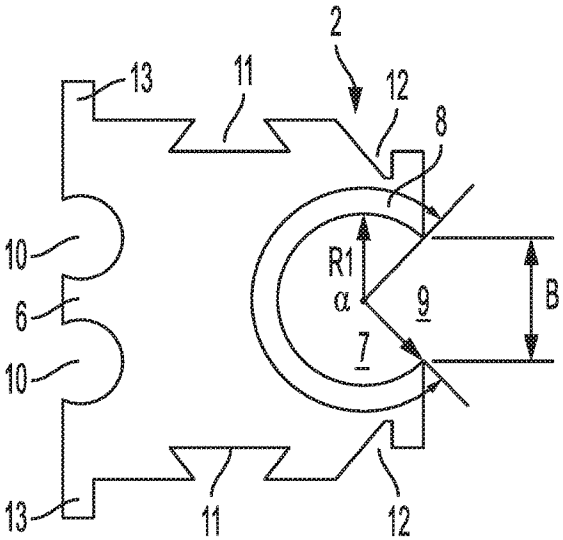
Figure 4:
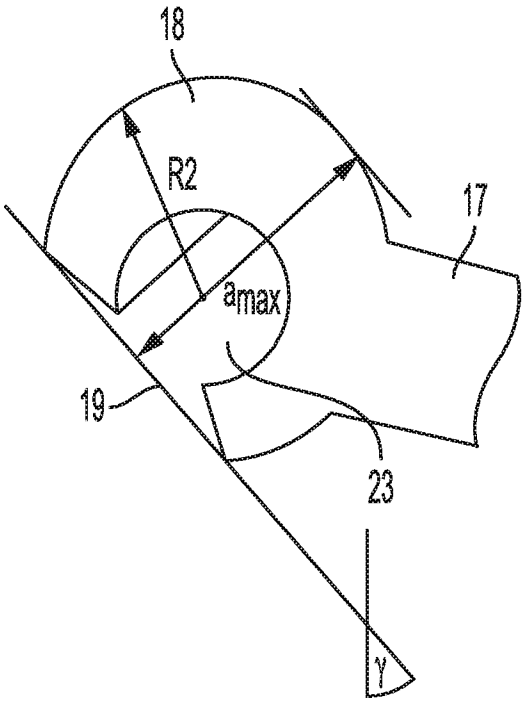
Figure 3:
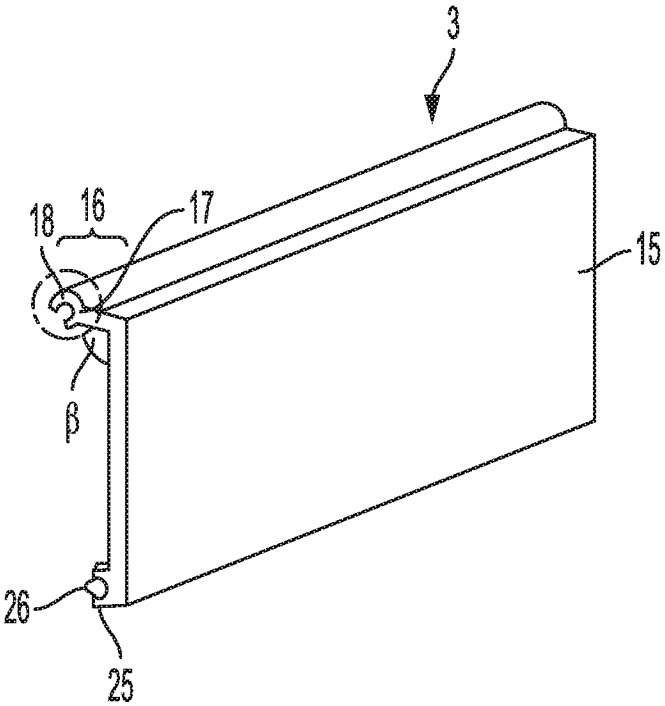
Figure 5:
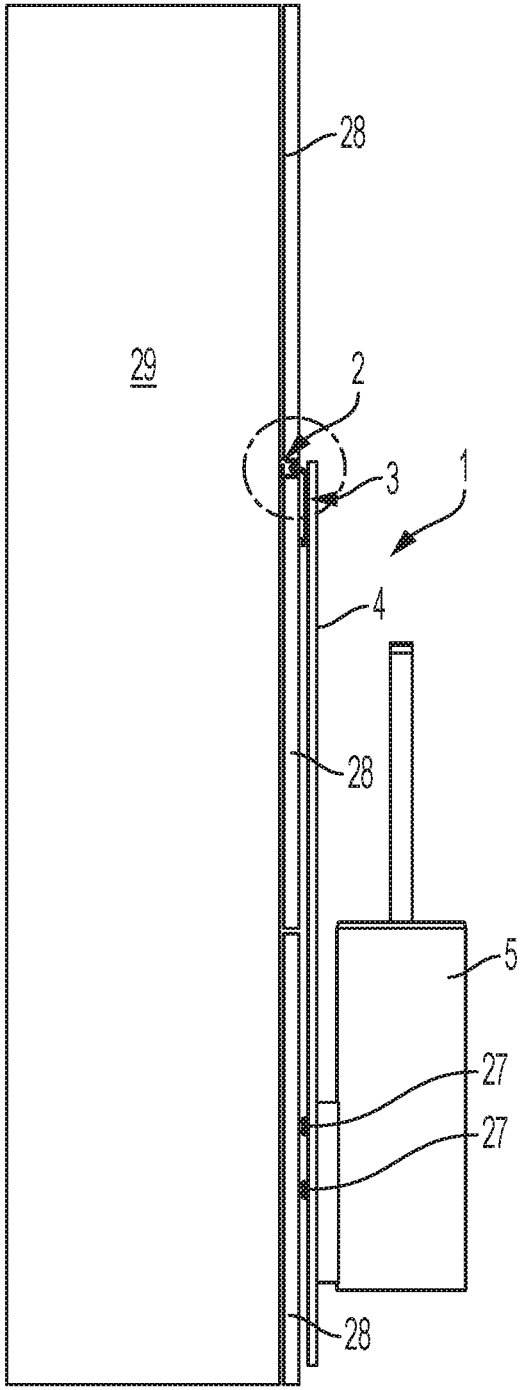
Figure 6:
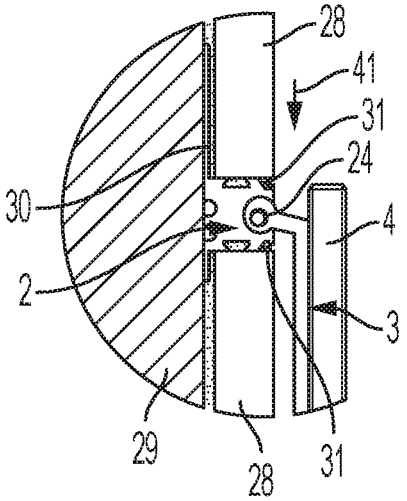
Figure 7:
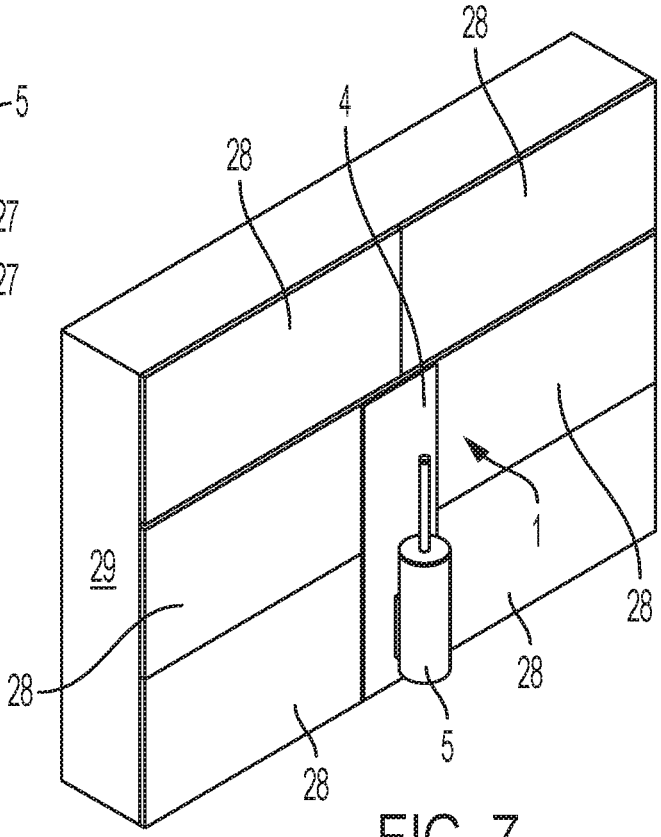
Figure 10:
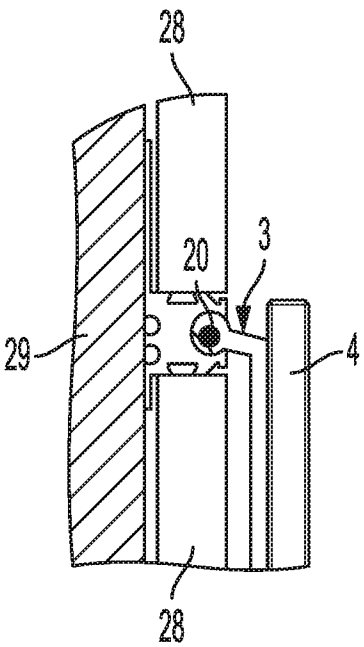
Figure 9:
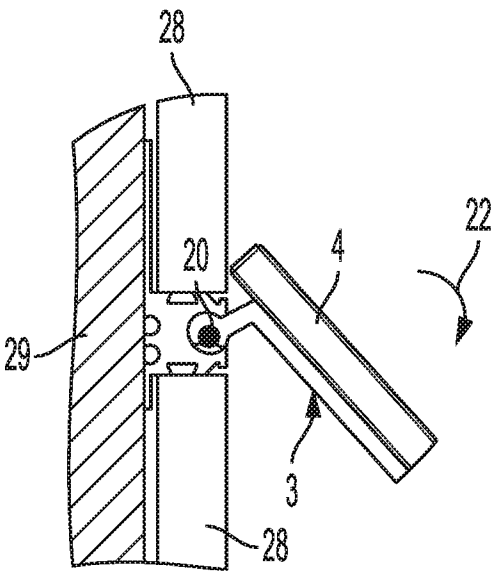
Figure 8:
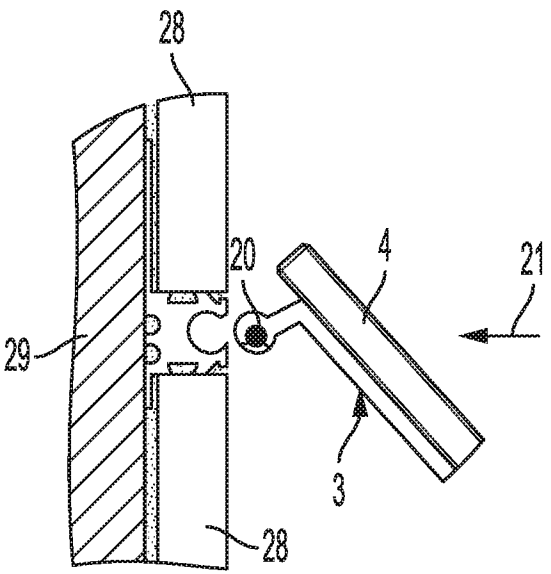
Figure 11:
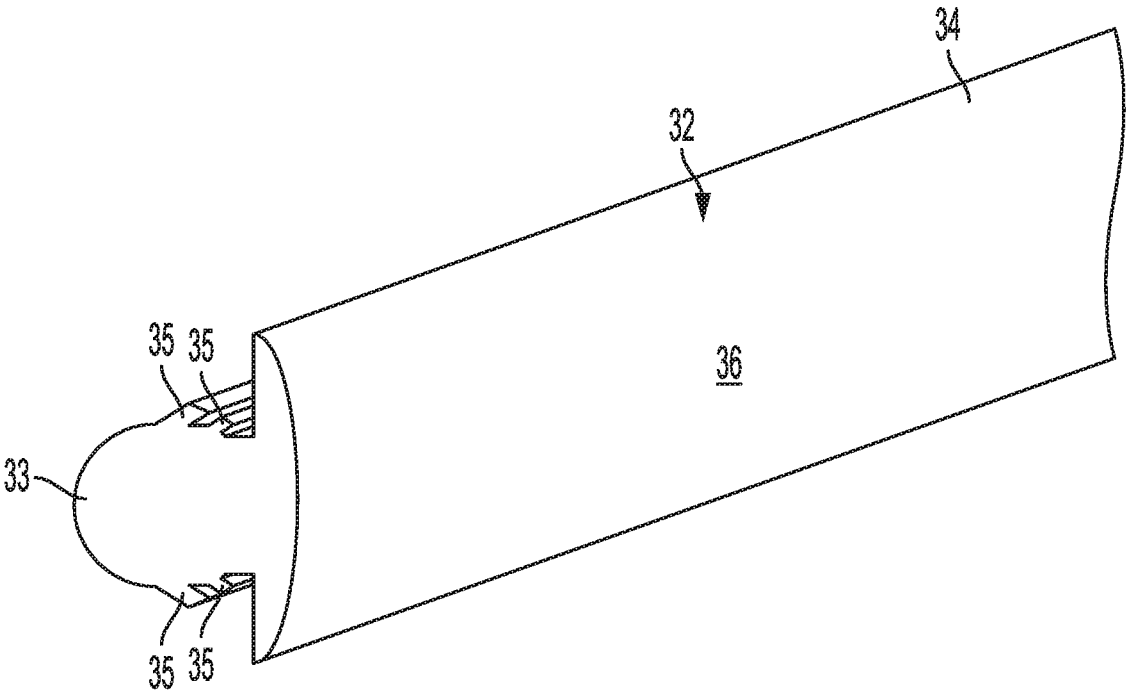
Figure 12:
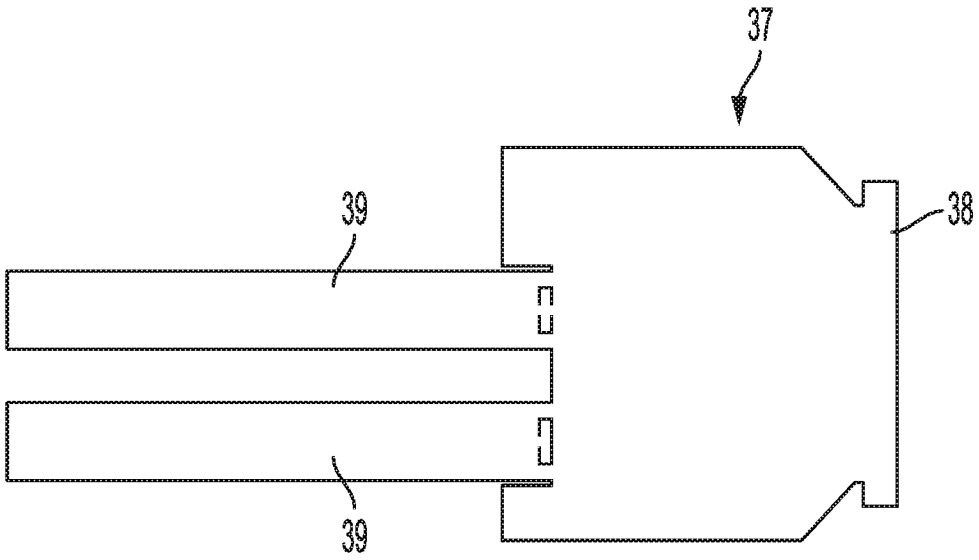
Figure 13:
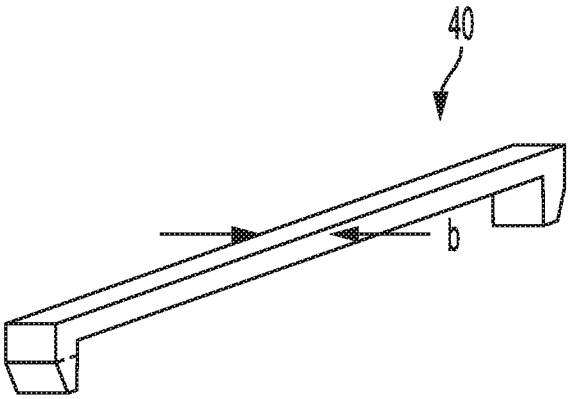
Figure 16:
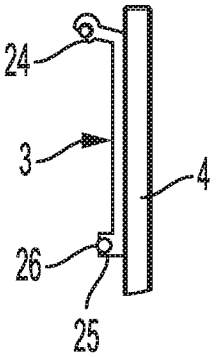
Figure 15:
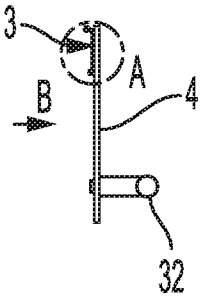
Figure 14:
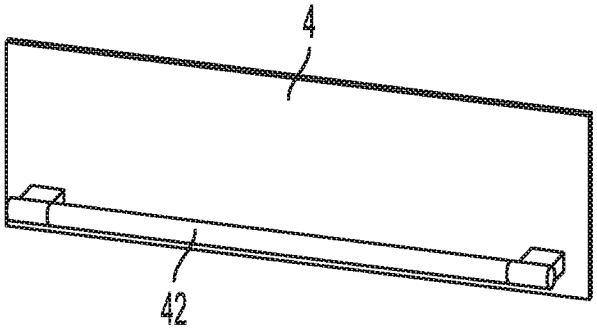
Figure 17:
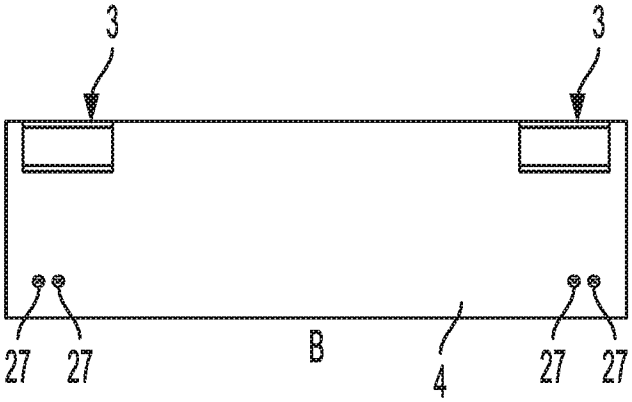
Figure 18:
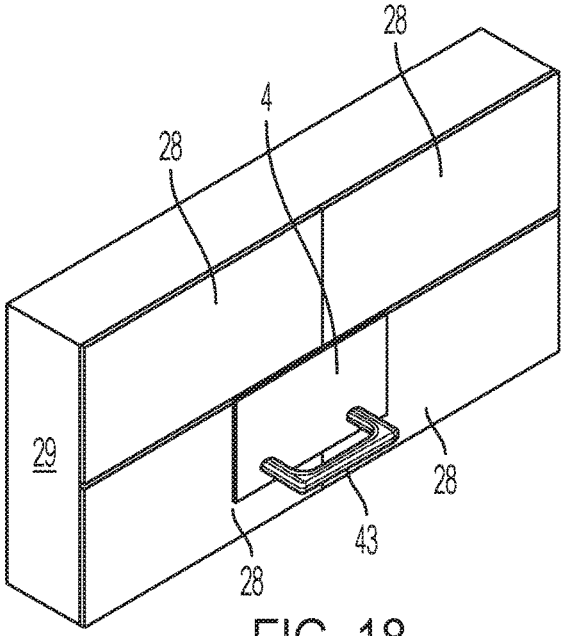
Figure 19:
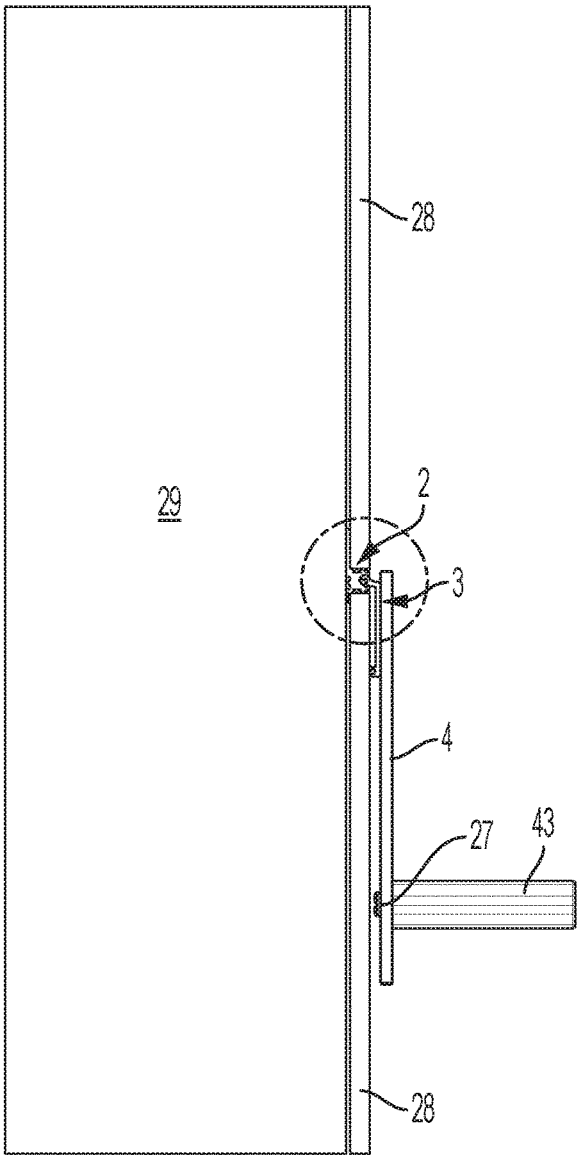
Figure 20:
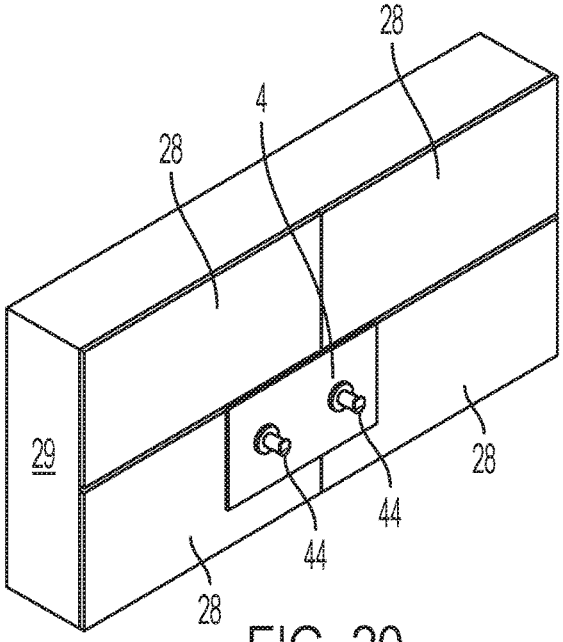
Figure 21:
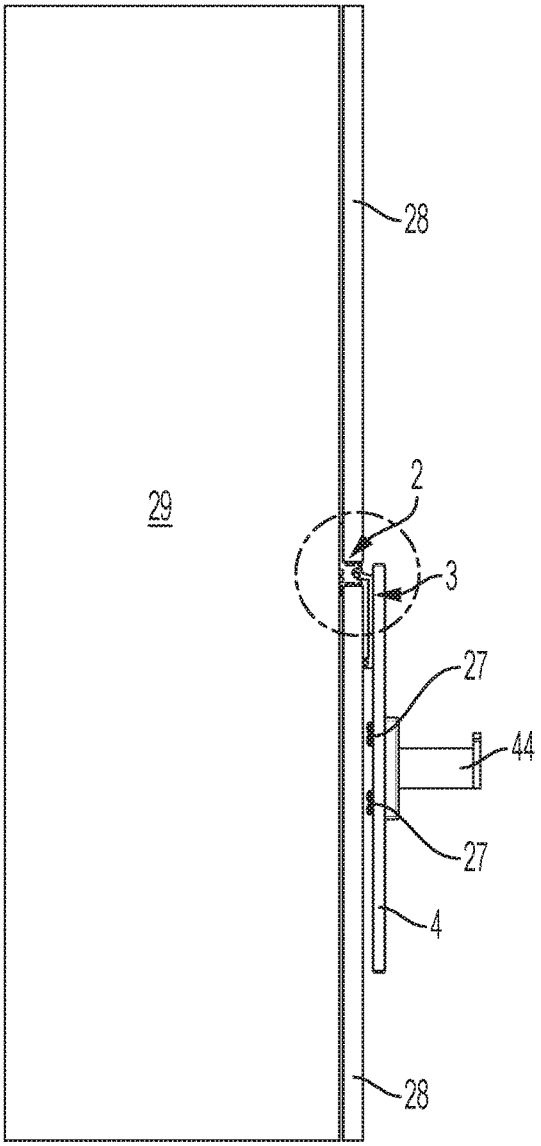
Figure 22:
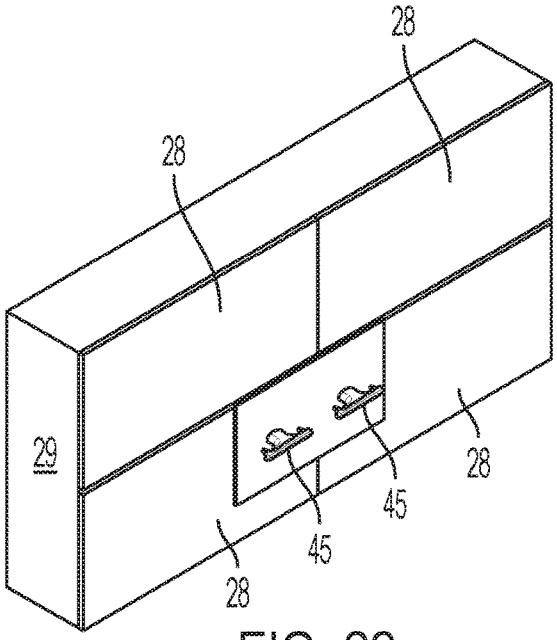
Figure 23A:
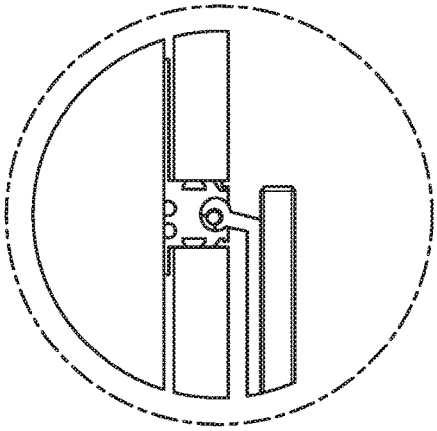
Figure 23:
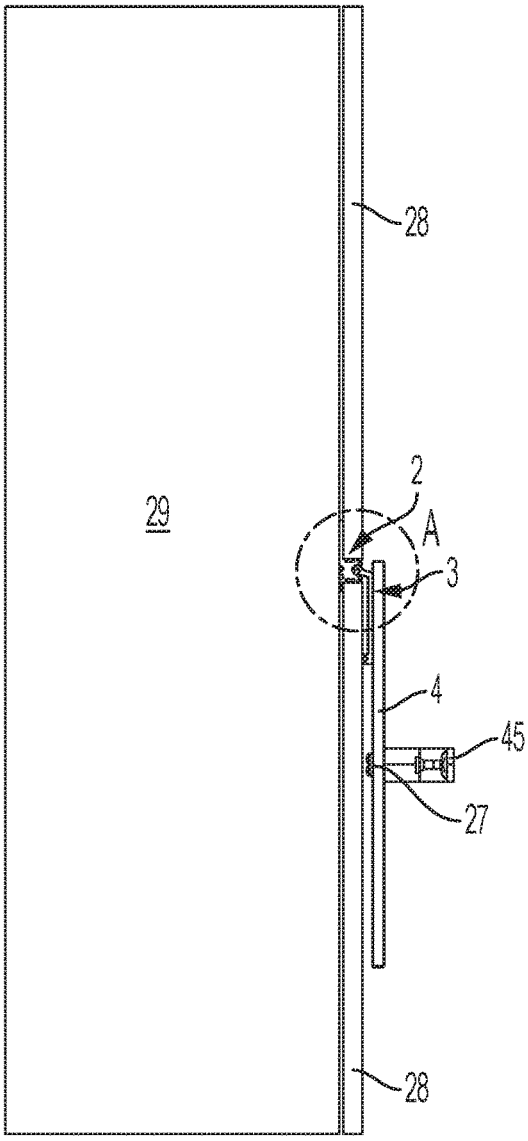
Figure 24:
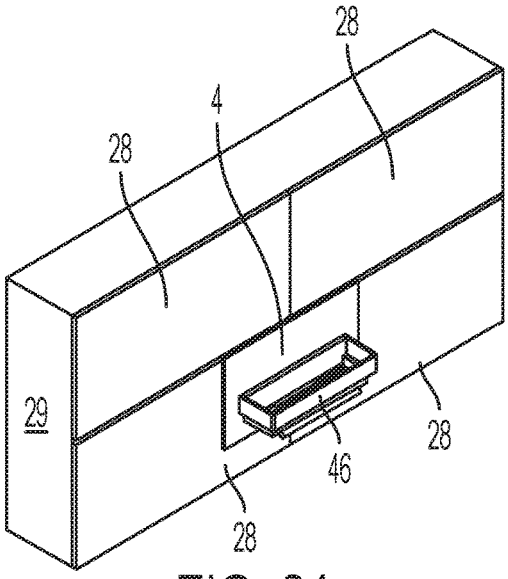
Figure 25:
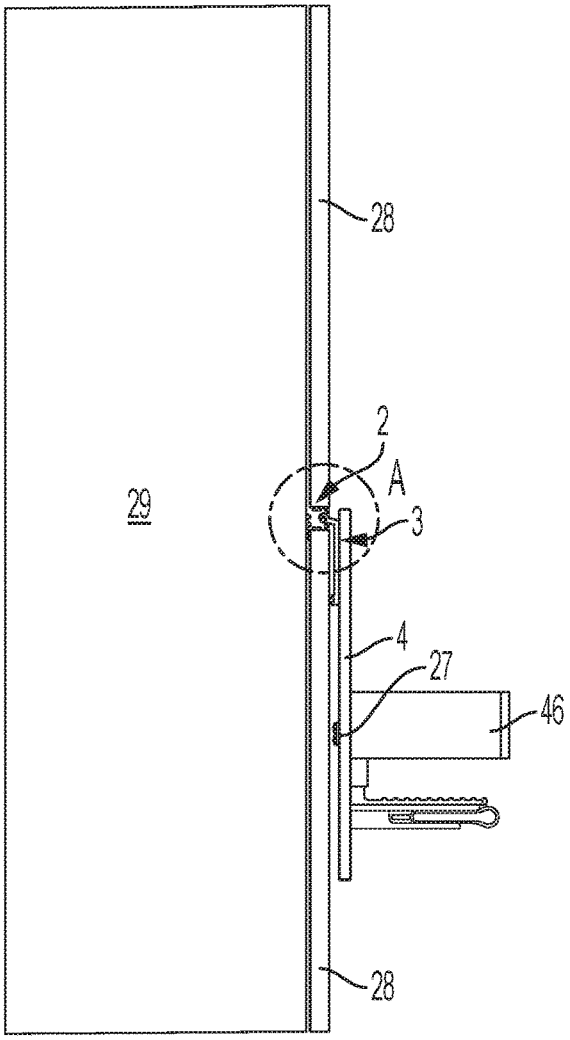
Figure 26:
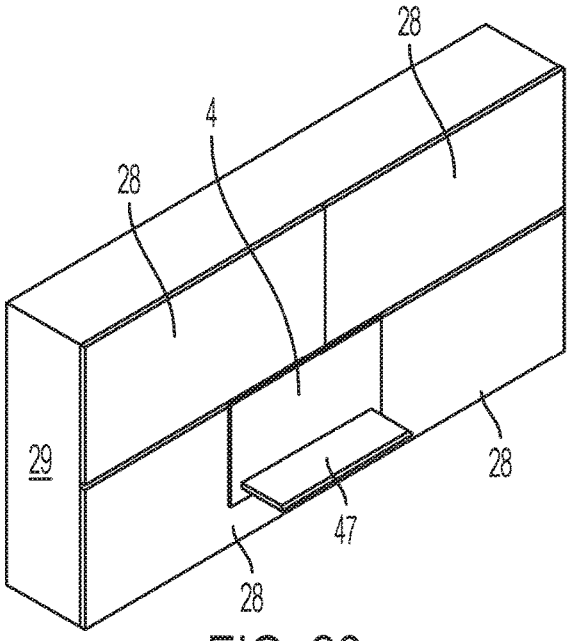
Figure 27:
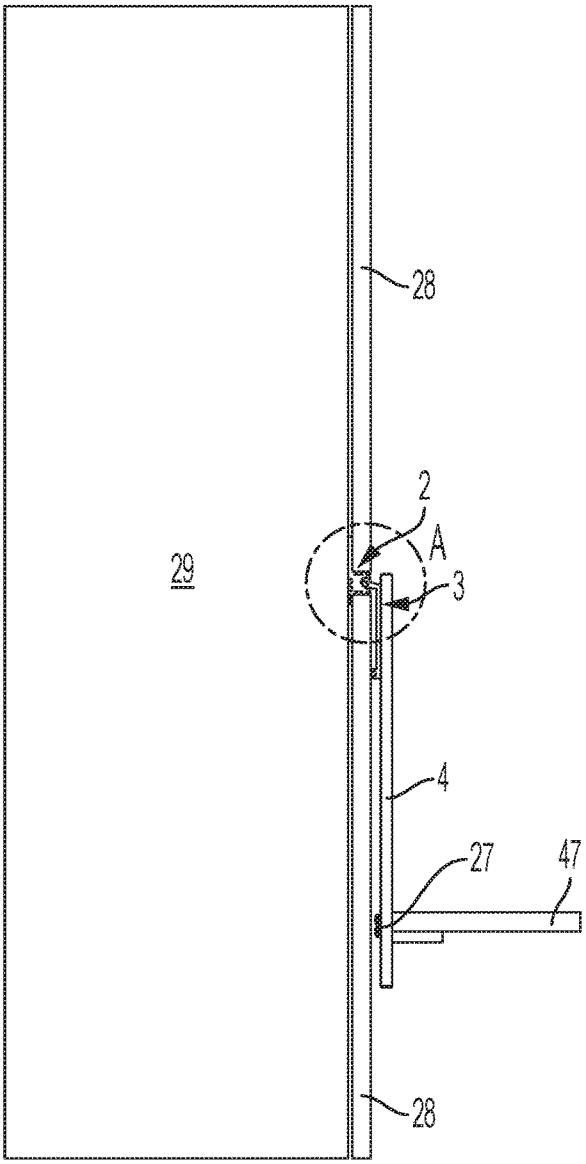
Figure 28:
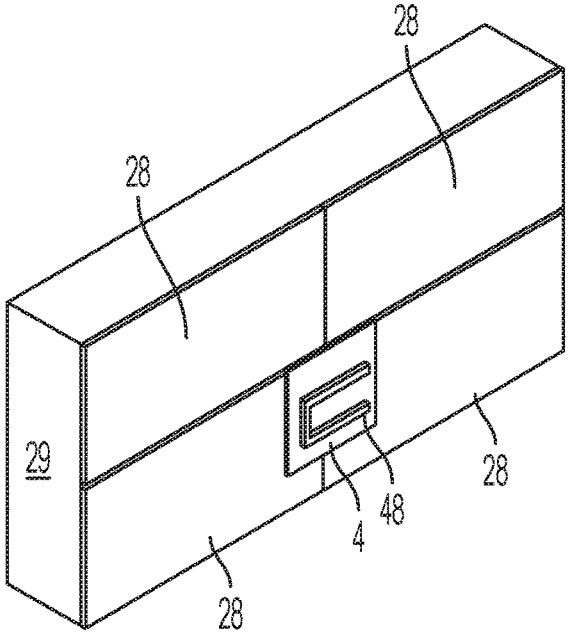
Figure 29:
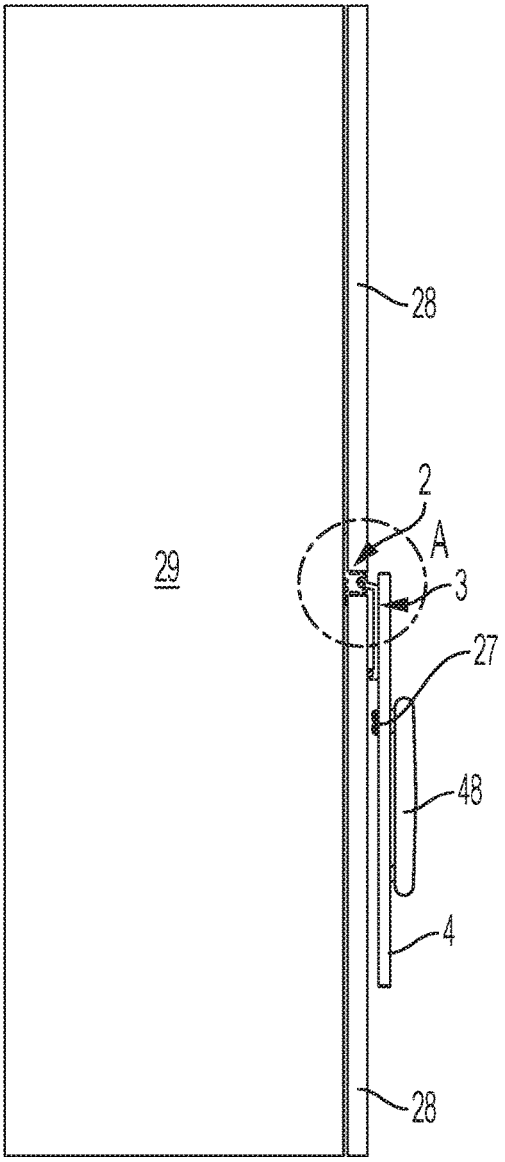

Further features and advantages of the present invention become clear by the following description of the embodiments of profile systems according to the invention with reference to the enclosed drawing. There is/are FIG. 1 a perspective view of a rail profile of a profile system according to an embodiment of the present invention;

FIG. 2 an enlarged view of section II in FIG. 1;

FIG. 3 a perspective view of a holding element of the profile system;

FIG. 4 an enlarged view of the section IV in FIG. 3;

FIG. 5 a side view of the profile system in the mounted state;

FIG. 6 an enlarged view of the section VI in FIG. 5;

FIG. 7 a perspective view of the arrangement shown in FIG. 5;

FIGS. 8-10 enlarged views analogous to FIG. 6, showing how the holding element and the profile element are brought into engagement with each other;

FIG. 11 a perspective view of a rubber profile of the profile system;

FIG. 12 a front view of an end cap of the profile system;

FIG. 13 a perspective view of a cover element of the profile system;

FIG. 14 a perspective view of components of a profile system according to a second embodiment of the present invention;

FIG. 15 a side view of the arrangement shown in FIG. 14;

FIG. 16 an enlarged view of the section XVI in FIG. 15;

FIG. 17 a rear view of the arrangement shown in FIG. 14;

FIG. 18 a perspective view of a profile system according to a third embodiment of the present invention in the mounted state;

FIG. 19 a side view of the arrangement shown in FIG. 18;

FIG. 20 a perspective view of a profile system according to a fourth embodiment of the present invention in the mounted state;

FIG. 21 a side view of the arrangement shown in FIG. 20;

FIG. 22 a perspective view of a profile system according to a fifth embodiment of the present invention in the mounted state;

FIG. 23 a side view of the arrangement shown in FIG. 22;

FIG. 24 a perspective view of a profile system according to a sixth embodiment of the present invention in the mounted state;

FIG. 25 a side view of the arrangement shown in FIG. 24;

FIG. 26 a perspective view of a profile system according to a seventh embodiment of the present invention in the mounted state;

FIG. 27 a side view of the arrangement shown in FIG. 26;

FIG. 28 a perspective view of a profile system according to an eighth embodiment of the present invention in the mounted state;

FIG. 29 a side view of the arrangement shown in FIG. 28; and

Figure 30:
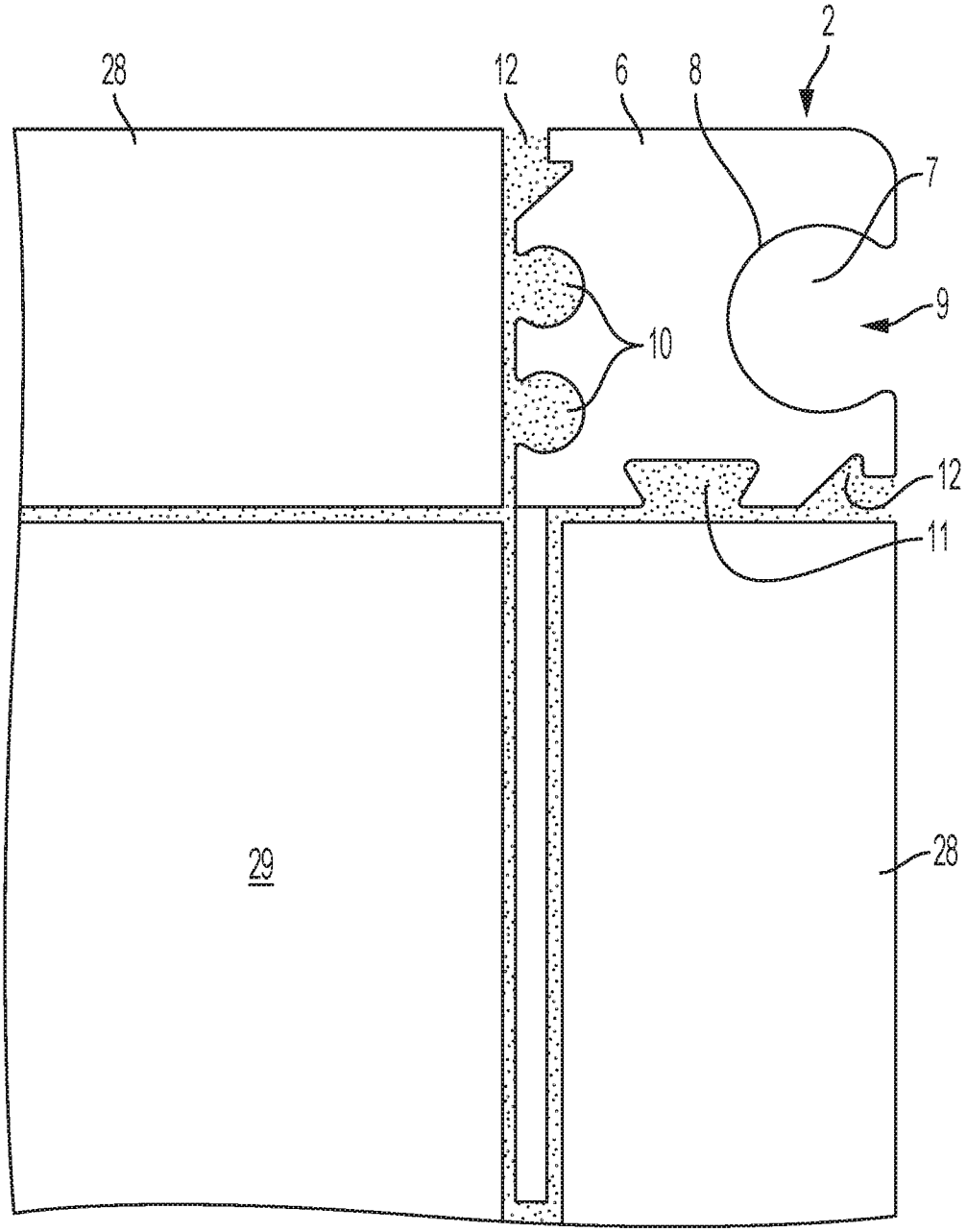

FIG. 30 a side view of an alternative embodiment of a rail profile of a profile system according to the invention in the installed state.

Identical reference numbers subsequently designate similarly designed components or component areas.

FIGS. 1 to 10 show a profile system 1 according to a first embodiment of the present invention, the main components of which are a profile rail 2, a holding element 3, a decorative plate 4 and a toilet brush set 5.

Rail profile 2 is an elongated rail profile extending in a longitudinal direction and having a constant cross-section, which is made of stainless steel. Alternatively, the rail profile 2 can also be made of aluminum or another material, such as plastic. The length of rail profile 2 is normally 1000 to 3000 mm when delivered and can then be shortened to any length before mounting. The rail profile 2, viewed in cross-section, comprises a substantially rectangular base section 6, which is provided at its front end with a receiving groove 7 extending in the longitudinal direction. The receiving groove 7 describes a circular arc 8 having a first radius $R_1$ and extending over an angle of at least 200°, sometimes about 270°, and is accessible via a groove opening 9 of a predetermined groove width B. Undercut recesses 10, 11 are provided on the rear side, the upper side and the underside of the base section 6. The two recesses 10 provided at the rear side have the shape of a part of a circle when viewed in cross-section. The recesses 11 on the upper side and the underside of the base section 6 have a dovetail shape. In the corner region between the underside and the front side as well as between the front side and the upper side of the base section 6, undercut recesses 12 are provided to define a grout chamber.

The rail profile 2 further comprises two fastening legs 13, which adjoin the rear side of the base section 6 substantially flush and protrude upwards and downwards in opposite directions outwards from the base section 6. Each of the fastening legs 13 is provided with plurality of passage openings 14 which are substantially uniformly spaced apart in the longitudinal direction L, the uniform spacing not being mandatory.

The holding element 3 is also made of stainless steel. As with rail profile 2, other materials can also be used. The holding element 3 comprises a presently plate-shaped holding section 15 and an elongatedly formed connecting section 16 fastened to the holding section 15 and extending in the longitudinal direction L. The connecting section 16 comprises a bar 17 extending outwards from the holding section 15 and a cylindrical joint head 18 which is arranged at the free end of the bar 17 and whose circumferential surface, viewed in cross-section, describes a circular arc with the radius $R_2$, which is equal to the radius $R_1$ or slightly, respectively a few tenth of mm smaller than the radius $R_1$. The maximum distance $a_{max}$ between the circular chord 19 delimiting the circular arc which, in relation to FIG. 4 extends at an angle γ to the holding section 15 which preferably lies in the range from 35° to 60°, and the circumferential surface is slightly smaller than the groove width B, so that the joint head 18, as it is shown in FIG. 8, can be inserted into the receiving groove 7 of the rail profile 2 via the groove opening 9 in the direction of the arrow 21 and can be locked in the context of a swivel movement about the swivel axis 20 in the direction of the arrow 22 within the receiving groove 7, see FIGS. 9 and 10. To facilitate the insertion of the joint head 18 into the receiving groove 7, the bar 17 of the connecting section 16 projects from the holding section 15 at an angle β in the range from 100° to 110°. In order to achieve tolerance compensation in the state shown in FIG. 10, the joint head 18 is provided in the area of the circular chord 19 with a receiving deepening 23 extending in the longitudinal direction, into which an elongated rubber lip 24 is inserted. This rubber lip 24 prevents the joint head 18 from being moved too easily within the receiving groove 7. At the rear side of the holding element 15 a spacer 25 is provided in the lower region, which spacer 25 is provided with an elastic contact element 26 which presently is also formed as a rubber lip.

The decorative plate 4 is fastened to the holding section 15 of the holding element 3, the holding element 3 being arranged and positioned in the upper region of the decorative plate 4 in such a way that the connecting section of the holding element 3 points upwards. The fastening of the holding section 15 of the holding element 3 at the decorative plate 4 is presently realized via an adhesive connection, wherein, basically, other types of fastening are also possible. The decorative plate 4 is preferably formed as a colored glass plate. Alternatively, this can also consist of any other material.

The toilet brush set is fastened in the lower region of the decorative plate 4 using screws 27, whereby other types of fastening are of course also possible here.

To manufacture the arrangement shown in FIGS. 5 to 7, during the laying of tiles 28 on a wall 29, the rail profile 4 is installed in a horizontal joint between two rows of tiles arranged one above the other in such a way that the fastening legs are embedded into the tile adhesive 30 and the base section 6 is positioned in the joint in such a way that the side edges of the tiles 28 lie against the underside and the upper side of the base section 6. The tile adhesive 30 penetrates the passage openings 14 of the upper fastening leg 13 and anchors itself in the recesses 10 and 11, whereby a good fastening of the rail profile 2 at the wall 29 is achieved. In a further step grout 34 is applied and claws itself in the recesses 12 of the base section 6 of the rail profile 2. In a subsequent step, after the tile adhesive 30 and the grout 31 have cured, the holding element 3 can be fastened to the rail profile 2 together with the decorative plate 4 and the toilet brush set 5, as described above with reference to FIGS. 8 to 10.

FIG. 11 shows a rubber profile 32 of the profile system 1 which basically can also be made of plastic. The rubber profile 32 comprises a fastening section 33 and a cover section 34, the fastening section 33 being adapted to be latchingly inserted into the receiving groove 7 of the rail profile 2, and the cover section 34 being adapted to cover the front side of the base section 6 of the rail profile 2 in the inserted state. For this purpose, the fastening section 33 is presently provided with upwardly and downwardly projecting ribs 35, which point in the direction of the cover section 34 and, when pressed into the receiving groove 7 of the rail profile 2, come in contact with the wall of the receiving groove 7. The cover section 34 presently comprises a convexly curved outer surface 36, whereby other forms of the outer surface 36 are also possible. The rubber profile 32 serves to fill those regions of the receiving groove 7 which are not occupied by the joint head 18 of the holding element. On one hand this is advantageous in that the holding element 3 cannot move back and forth in the receiving groove 7 when in the inserted position. On the other hand, the receiving groove 7 is also covered so that it can not get dusty. In addition, a good visual appearance is achieved.

FIG. 12 shows an end cap 37 of the profile system 1, which is adapted to be plugged at the ends onto the rail profile 2, in order to prevent the penetration of tile adhesive 30, especially when rail profile 2 is installed. The end cap 37 is presently made of a sheet and comprises a plate section 38 covering the end of the rail profile 2, the outer contour of which corresponds substantially to the outer contour of the end face of the rail profile 2, and two plug sections 39 projecting from the plate section 38, the dimensions of which are selected in such a way that they can be inserted into the recesses 10 of the rail profile 2 and fixed therein. For this purpose, plug sections 39 shown in FIG. 12 are bent by 90° so that they can be inserted into the recesses.

FIG. 13 shows a cover element 40 which is designed to be placed on the holding section of the holding element 3 from above in the direction of the arrow 41 in FIG. 6 as a cover and to prevent the holding element 3 from swiveling upwards and thus accidentally releasing it in the inserted state. The cover element 40 is substantially C-shaped, so that the downwardly protruding legs can grip the holding sections 15 of the holding element 3 laterally. The width B of the cover element 40 is selected in such a way that the cover element 40 can be positioned between the base section 6 of the rail profile 2 and the decorative plate 4 when the profile system 1 is mounted according to FIG. 6.

FIGS. 14 to 17 show a profile system 1 according to a second embodiment of the present invention or parts thereof. The only differences to the first embodiment described above are the dimensions of the decorative plate 4 and the fact that two holding elements 3 are attached to the decorative plate 4 in order to fasten them detachably to the rail profile. In addition, instead of a toilet brush set 5, a long towel rail 42 is fastened in the lower area of the decorative plate 4.

FIGS. 18 and 19 show a profile system 1 according to a third embodiment of the present invention or parts thereof. The only differences to the first embodiment described above are the dimensions of the decorative plate 4 and the fact that instead of the toilet brush set 5 a short towel holder bar 43 is fastened in the lower region of the decorative plate 4.

FIGS. 20 and 21 show a profile system 1 according to a fourth embodiment of the present invention or parts thereof. The only differences to the first embodiment described above are the dimensions of the decorative plate 4 and the fact that instead of the toilet brush set 5 there are two substantially L-shaped towel hooks 44 in the lower region of the decorative plate 4.

FIGS. 22 and 23 show a profile system 1 according to a fifth embodiment of the present invention or parts thereof.

The only differences to the first embodiment described above are the dimensions of the decorative plate 4 and the fact that instead of the toilet brush set 5, two towel hooks 45, which are substantially T-shaped, are positioned in the lower region of the decorative plate 4.

FIGS. 24 and 25 show a profile system 1 according to a sixth embodiment of the present invention or parts thereof. The only differences to the first embodiment described above are the dimensions of the decorative plate 4 and the fact that instead of the toilet brush set 5 a shower gel tray 46 is fixed in the lower area of the decorative plate 4. The structure of the shower gel tray 46 is basically variable which is why it will not be discussed in more detail below.

FIGS. 26 and 27 show a profile system 1 according to a seventh embodiment of the present invention or parts thereof. The only differences to the first embodiment described above are the dimensions of the decorative plate 4 and the fact that instead of the toilet brush set 5, a shelve-like tray 47 made of glass or the like is arranged in the lower region of the decorative plate 4.

FIGS. 28 and 29 show a profile system 1 according to an eighth embodiment of the present invention or parts thereof. The only differences to the first embodiment described above are the dimensions of the decorative plate 4 and the fact that instead of the toilet brush set 5 a toilet roll holder 48 is fastened to the lower region of the decorative plate 4.

FIG. 30 shows an alternative rail profile 2 of the profile system 1 which differs only from the rail profile 2 described above in that only a single fastening leg 13 extends downwards from the base section 6 and that the recesses 12 defining the grout chambers are arranged in the corner regions between the underside and the front side as well as between the upper side and the rear side of the base section 6. Such a rail profile 2 can, for example, be used in outer corner areas, as indicated by tiles 28.

It should be clear that the above-described embodiments should only be taken as examples and in no way as restrictive. Rather, changes and modifications can be made of the embodiments without leaving the scope of protection defined by the enclosed claims.

REFERENCE CHARACTER LIST

1 Profile system
2 Rail profile
3 Holding element
4 Decorative plate
5 Toilet brush set
6 Base section
7 Receiving groove
8 Circular arc
9 Groove opening
10 Recess
11 Recess
12 Recess
13 Fastening leg
14 Passage opening
15 Holding section
16 Connecting section
17 Bar
18 Head joint
19 Circular chord
20 Swivel axis
21 Arrow
22 Arrow
23 Receiving deepening
24 Rubber lip
25 Spacer
26 Contact element
27 Screw
28 Tile
29 Wall
30 Tile adhesive
31 Grout
32 Rubber profile
33 Fastening section
34 Cover section
35 Rib
36 Outer surface
37 End cap
38 Plate section
39 Plug section
40 Cover element
41 Arrow
42 Towel rail
43 Towel rail
44 Towel hook
45 Towel hook
46 Shower gel tray
47 Tray
48 Toilet paper roll holder
L Longitudinal
B Slot width
b width
$a_{max}$ Maximum distance α, β, γ Angle

I claim:

1. A profile system (1) comprising at least one elongated rail profile (2), which extends in a longitudinal direction (L) and has a constant cross-section, and at least one holding element (3) detachably fastenable to the rail profile (2), wherein the rail profile (2), viewed in cross-section, has a substantially rectangular base section (6), which is provided on its front side with a receiving groove (7) extending in the longitudinal direction (L) which describes a circular arc (8) extending over at least 200° and having a first radius $R_1$ and is accessible via a groove opening (9) of a predetermined groove width (B), and at least one first fastening leg (13) which adjoins a rear side of the base section (6) substantially flush and projects outwards from the base section (6), and wherein the holding element (3) has a holding section (15) and an elongatedly formed connecting section (16) fastened to the holding section (15) and extending in the longitudinal direction (L), the connecting section (16) comprising at least one bar (17) extending outwards from the holding section (15) and a cylindrical joint head (18) which is arranged at a free end of the bar (17) and whose circumferential surface, viewed in cross-section, describes a circular arc with a radius $R_2$, which is equal or smaller than the radius $R_1$, a maximum distance ($a_{max}$) between a circular chord (19) delimiting the circular arc and the circumferential surface being smaller than the groove width (B) so that the joint head (18) can be inserted into the receiving groove (7) via the groove opening (9) in a specific swivel position of the holding element (3) relative to a swivel axis (20) extending in the longitudinal direction (L) and can be locked within the receiving groove (7) in the context of a swivel movement about the swivel axis (20).

2. A profile system (1) according to claim 1, further comprising undercut recesses (10, 11) provided on at least one of the rear side, an upper side, or an underside of the base section (6) of the rail profile (2).

3. A profile system (1) according to claim 1, further comprising a recess (12) having an undercut provided in a corner region between the underside and the front side of the base section (6) and/or in a corner region between the front side and the upper side of the base section (6) and/or in a corner region between the upper side and the rear side of the base section (6), said recess (12) defining a grout chamber.

4. A profile system (1) according to claim 1, wherein the fastening leg (13) is provided with a plurality of passage openings (14), which are uniformly spaced apart from one another in the longitudinal direction (L).

5. A profile system (1) according to claim 1, wherein the rail profile (2) and the holding element (3) are made of metal, in particular of aluminum or stainless steel.

6. A profile system (1) according to claim 1, wherein the holding section (15) is plate-shaped.

7. A profile system (1) according to claim 1, wherein the bar (17) of the connecting section (16) projects from the holding section (15) at an angle (β) in the range from 100° to 110°.

8. A profile system (1) according to claim 1, wherein the joint head (18) is provided with a receiving deepening (23) extending in the longitudinal direction (L), into which a rubber lip (24) serving for tolerance compensation is inserted.

9. A profile system (1) according to claim 1, further comprising a spacer (25) provided on a rear side of the holding section (15), the spacer being provided with an elastic contact element (26).

10. A profile system (1) according to claim 1, further comprising a decorative glass plate (4) fastened to the holding section (15).

11. A profile system (1) according to claim 10, further comprising a bath utensil fixed to the decorative plate (4), the bath utensil comprising one of a towel holder, a toilet paper roll holder, a toilet brush set, or a shower gel tray.

12. A profile system (1) according to claim 1, further comprising a rubber profile (32) adapted to be clipped into the receiving groove (7).

13. A profile system (1) according to claim 12, wherein the rubber profile (32) comprises a fastening section (33) and a cover section (34), the fastening section (33) being adapted to be latchingly inserted into the receiving groove (7), and a cover section (34) being adapted to cover the front side of the base section (6) in the inserted state.

14. A profile system (1) according to claim 13, wherein the fastening section (33) comprises upwardly and downwardly projecting ribs (35) which point in the direction of the cover section (34).

15. A profile system (1) according to claim 14, wherein the cover section (34) has a convexly curved outer surface (36).

16. A profile system (1) according to claim 1, further comprising at least one end cap (37) that is adapted to be plugged onto the rail profile (2) at ends of the rail profile, the end cap (37) having a plate section (38) which covers the rail profile at the ends and whose outer contour corresponds to an outer contour of the end face of the rail profile (2) and at least one plug section (39) projecting from the plate section (38).

17. A profile system (1) according to claim 1, further comprising a cover element (40) which is adapted to be placed as a cover at least on the holding section (15) of the holding element (3), the cover element (40) having a substantially C-shaped form.

* * * * *